United States Patent [19]

Riley et al.

[11] 4,139,583

[45] Feb. 13, 1979

[54] THROTTLE BODY ASSEMBLY

[75] Inventors: Donald E. Riley, Farmington; Kenneth A. Graham, Birmingham; Ian J. C. Scott, Madison Heights; S. Duane Ogden, Royal Oak, all of Mich.

[73] Assignee: Chrysler Corporation, Highland Park, Mich.

[21] Appl. No.: 860,926

[22] Filed: Dec. 15, 1977

[51] Int. Cl.[2] ..... F02M 17/40

[52] U.S. Cl. ..... 261/65; 261/DIG. 56; 251/212; 251/314

[58] Field of Search ..... 261/65, DIG. 56; 251/314, 316, 306, 212

[56] References Cited

U.S. PATENT DOCUMENTS

| | | | |
|---|---|---|---|
| 926,174 | 6/1909 | Clark | 251/306 |
| 1,061,835 | 5/1913 | Gobbi | 261/62 |
| 1,437,423 | 12/1922 | Jackson | 261/65 |
| 2,548,128 | 4/1951 | Snyder | 251/314 |
| 3,421,544 | 1/1969 | Bozoyan | 137/625.31 |
| 4,006,883 | 2/1977 | Hilsheimer | 251/314 |
| 4,044,077 | 8/1977 | Gupta | 261/23 A |
| 4,066,721 | 1/1978 | Graham | 261/65 |

*Primary Examiner*—Tim R. Miles

*Attorney, Agent, or Firm*—Baldwin & Newtson

[57] ABSTRACT

A throttle body assembly wherein a pair of throttle blades are counter-rotatably mounted in the induction passage and define at their juxtaposition venturi sections whose size is variable in accordance with the degree of rotation of the throttle blades. The blades are peripherally sealed with respect to the walls of the induction passage by means of wiper type seals affixed to each blade as well as by caged roller type seals.

8 Claims, 12 Drawing Figures

THROTTLE BODY ASSEMBLY

BACKGROUND AND SUMMARY OF THE INVENTION

This invention pertains to a novel throttle body assembly which is particularly useful in connection with an electronic fuel metering system.

The application of Kenneth A. Graham, Ser. No. 719,206 filed Aug. 30, 1976 and assigned to the same assignee as the present application, now U.S. Pat. No. 4,066,721, discloses a throttle body assembly having a novel type throttle blade. In certain respects the present invention represents an improvement upon the throttle body of that earlier application. One advantage of the present invention is that improved quality of engine operation is attained at idle and in the part throttle range encountered at light engine loads. This advantage is believed achieved with the present invention through improved mixture and atomization of fuel with the induction air. Pursuant to the present invention counter-rotatable throttle blades cooperatively define variable venturi sections which are located centrally within the induction passage and are selectively variable in effective size from idle up through the light load, part throttle range of operation. In a limited range prior to full throttle, the blades separate at the venturi sections to permit maximum air flow centrally through the throttle body between the separated blades. In achieving the improved operation with the present invention, the peripheries of the throttle blades are sealed with respect to the walls of the induction passage by improved sealing arrangements. Thus, air flow in all modes of throttle operation is confined to and selectively controlled within the central region of the induction passage. In the application of the throttle body of the present invention to an electronic fuel metering system, metered fuel jets may be poised at the central region of the induction passage directly over the venturi sections to spray fuel into the induction passage.

The foregoing features, advantages and benefits of the invention along with additional ones, will be seen in the ensuing description and claims which are to be considered in conjunction with the accompanying drawings.

BRIEF DESCRIPTION OF THE DRAWINGS

The drawings illustrate a preferred embodiment of the invention according to the best mode presently contemplated in carrying out the invention.

FIG. 6 is a plan view of one of the assembly elements of FIG. 5 shown by itself.

DESCRIPTION OF THE PREFERRED EMBODIMENT

Figure 1:
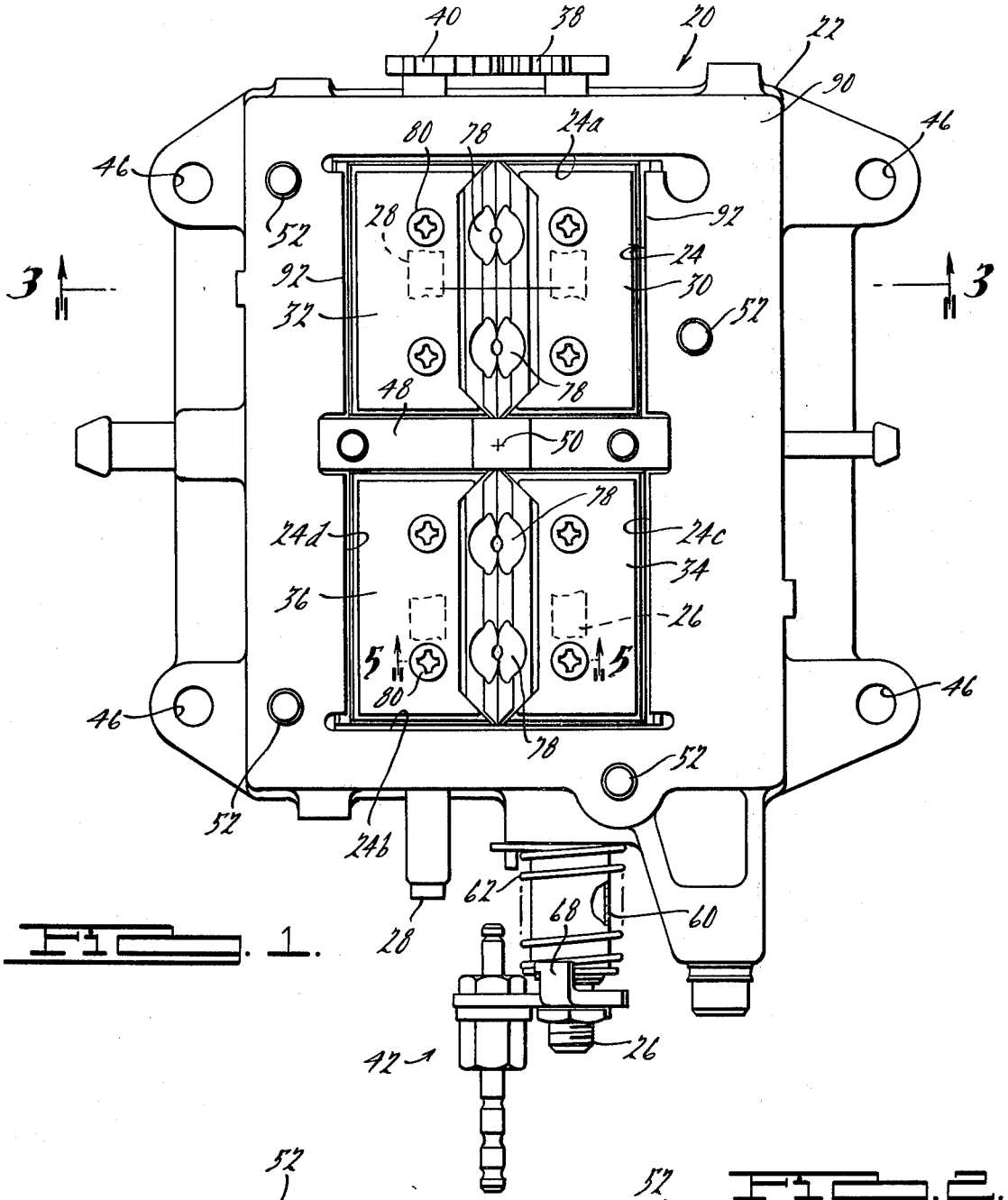
FIG. 1 is a plan view of a throttle body assembly embodying principles of the present invention.

The drawings illustrate a preferred embodiment of throttle body assembly 20 embodying principles of the present invention. Assembly 20 comprises a throttle body 22 having an induction passage 24; a pair of throttle shafts 26, 28; four individual throttle blade assemblies 30, 32, 34, 36; a pair of meshed sector gears 38, 40; and an actuating mechanism 42. Throttle body 22 has a base 44 adapted to be positioned on an engine intake manifold (not shown) to register induction passage 24 with the inlet port of the intake manifold. Attachment may be effected by means of bolts (not shown) passing through holes 46 at the four corners of base 44 with a suitable gasket (not shown) disposed between throttle body 22 and the intake manifold. In the preferred embodiment disclosed herein induction passage 24 has a rectangular cross sectional shape as shown in FIG. 1. Passage 24 is divided in two halves, or ports, by means of a vertical partition 48 of throttle body 22 which intersects the main axis 50 of the induction passage, thus bisecting the induction passage. A fuel distribution system (not shown) including a spray bar is adapted to be mounted on the partition 48 so that fuel may be sprayed into the induction passage for mixture with the induction air. A plurality of upright studs 52 provide for the mounting of additional structure on the throttle body, for example, an engine air filter housing containing an engine air filter.

Shafts 26 and 28 extend across the induction passage between the opposite passage walls **24*a*, 24*b* with shaft 26 being disposed approximately half-way between wall 24*c* and axis 50 and shaft 28 approximately half-way between wall 24*d* and axis 50. Each shaft is rotatable about its own axis 54, 56 and the two are parallel to each other as well as to the walls 24*c*, 24*d*. The shafts are suitably journaled in throttle body 22 at walls 24*a*, 24*b*, as well as at partition 48 through which the two shafts pass. As can be seen at the top of FIG. 1 the ends of the shafts 26, 28 extend beyond throttle body 22 and the two meshed sector gears 38, 40 are fixed to shafts 26 and 28, respectively. The sector gears are so meshed as to couple shafts 26 and 28 for rotation in unison in opposite directions as viewed axially of the shafts. Blade assemblies 30 and 34 are affixed to shaft 26 and blade assemblies 32 and 36 to shaft 28 so that blade assemblies 30 and 32 form one cooperating pair of counter-rotatable blades for one port and blade assemblies 34 and 36** another for the other port. The blade assemblies are preferably at least approximately balanced on their shafts so that the pressure differential across the blades cannot develop any significant rotational torque. This means that extraordinary torques are neither required to maintain the blades in idle position to which they are typically biased via the usual accelerator linkage return spring (not shown) nor required to operate the blades over their operating range.

Figure 2:
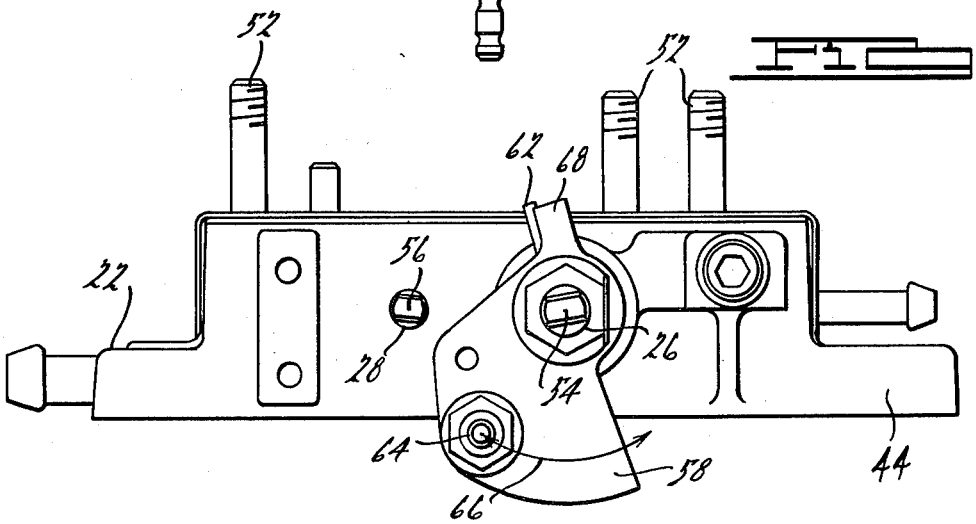
FIG. 2 is a front view of the assembly of FIG. 1.

Actuating mechanism 42 serves to counter-rotate shafts 26 and 28, and hence the two throttle blade assemblies of each cooperating pair, in response to operation of the usual accelerator linkage provided in a vehicle. The illustrated actuating mechanism comprises a throttle arm 58, a sleeve 60 and a helical spring 62. As shown at the bottom of FIG. 1 shaft 26 extends beyond throttle body 22 a distance sufficient to accommodate the actuating mechanism 42. Sleeve 60 is disposed over the end of shaft 26 to support spring 62 thereon. Throttle arm 58 is affixed to shaft 26. The throttle arm includes a pin 64 which is intended to connect the accelerator linkage (not shown) whereby the throttle arm in response to the operation of the accelerator pedal by the vehicle operator, may be operated over an angular range indicated by the arrow 66 in FIG. 2. Spring 62 is torsionally interengaged between throttle body 22 and a tab 68 on throttle arm 58 whereby the throttle arm is biased in the clockwise direction as viewed in FIG. 2. (FIG. 2 illustrates the throttle body assembly in the engine idle position.) Thus, as the throttle arm is increasingly displaced along the arc defined by arrow 66 from the idle position, the shafts 26 and 28 counter-rotate in unison in turn to counter-rotate the two throttle blade assemblies of each pair.

Figure 3:
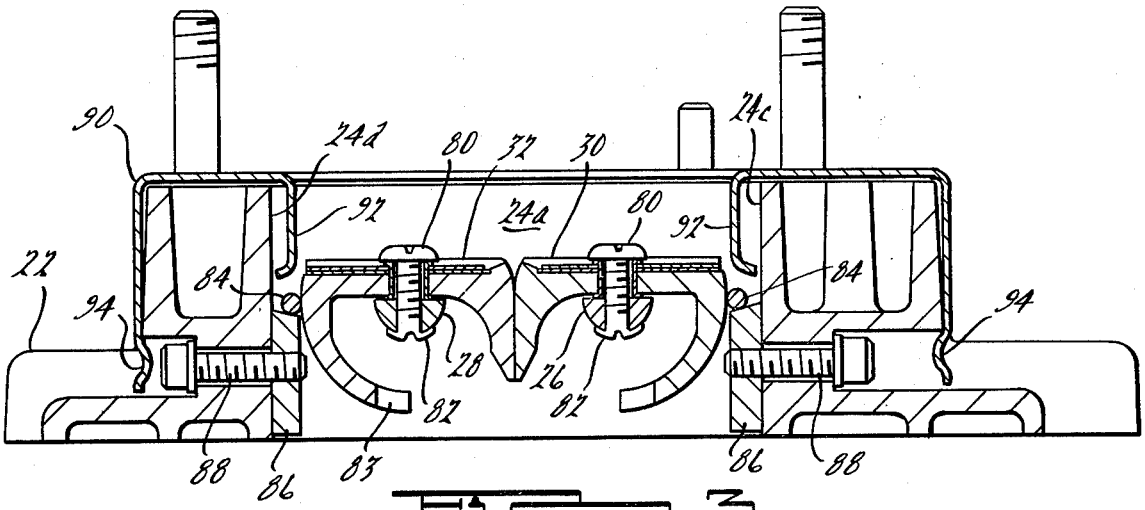
FIG. 3 is a sectional view taken in the direction of arrows 3—3 in FIG. 1 and illustrating a first operative position.
Figure 4:
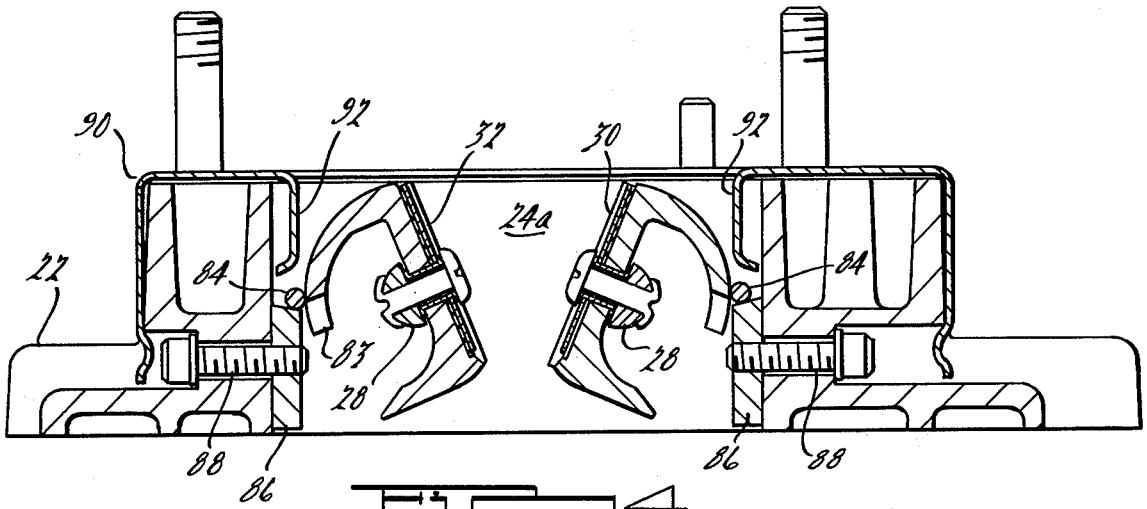
FIG. 4 is a view similar to FIG. 3 illustrating another operative position.
Figure 5:
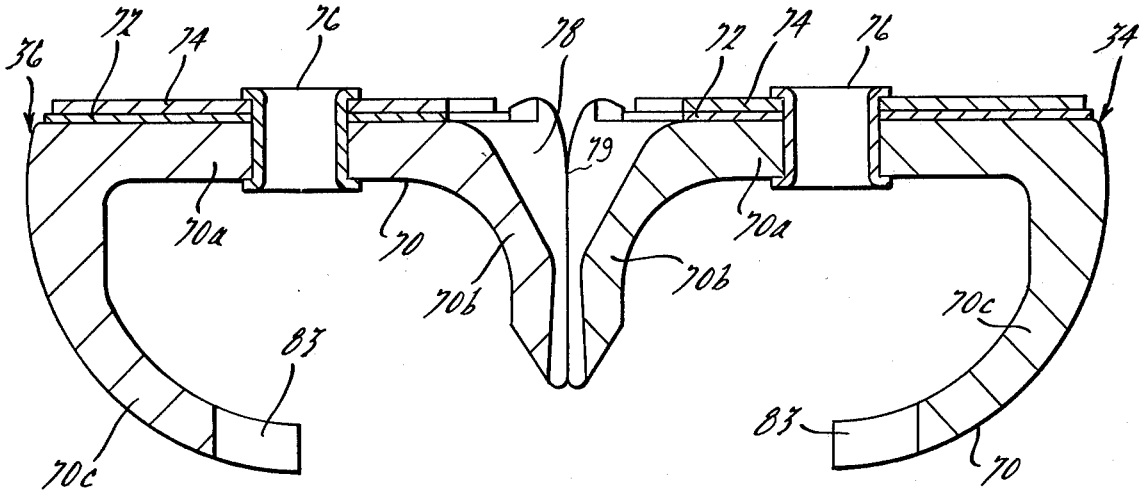
FIG. 5 is a view taken in the direction of arrows 5—5 in FIG. 1 on an enlarged scale and having portions omitted.
Figure 5:
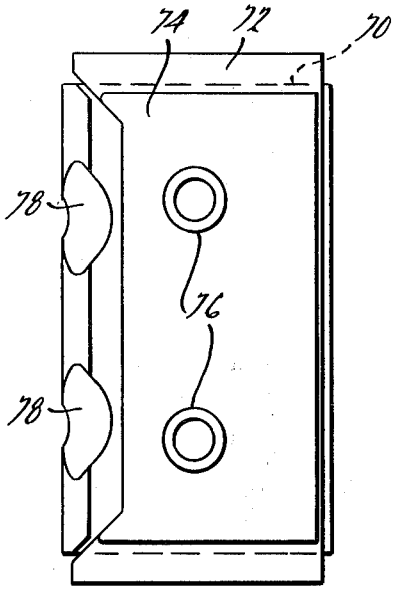
Figure 7:
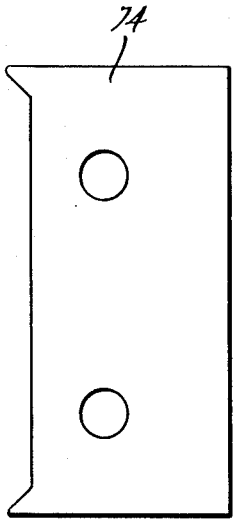
FIG. 7 is a plan view of one of the elements of FIG. 6 shown by itself.
Figure 8:
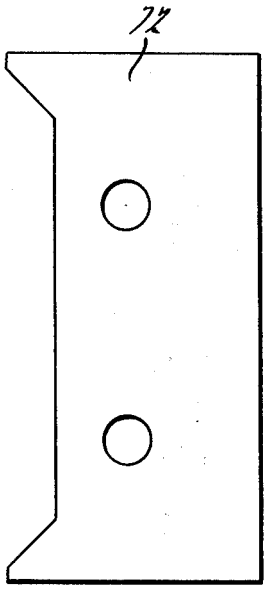
FIG. 8 is a plan view of another of the elements of FIG. 6 shown by itself.
Figure 10:
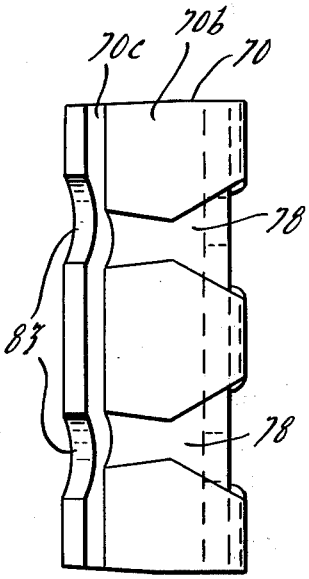
FIG. 10 is a left side view of the element of FIG. 9.
Figure 9:
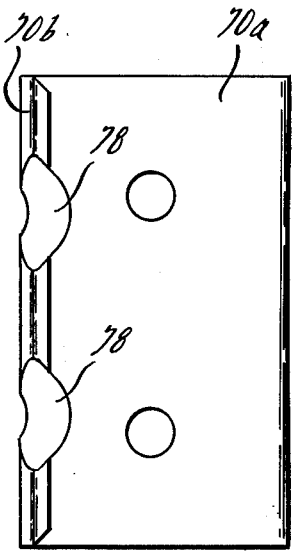
FIG. 9 is a plan view of yet another of the elements of FIG. 6 shown by itself.
Figure 12:
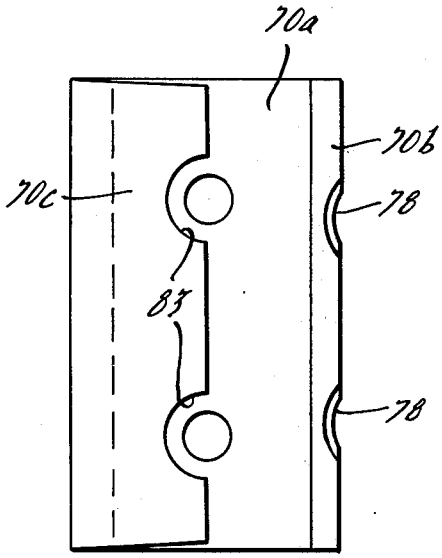
FIG. 12 is a bottom view of the element of FIG. 9.
Figure 11:
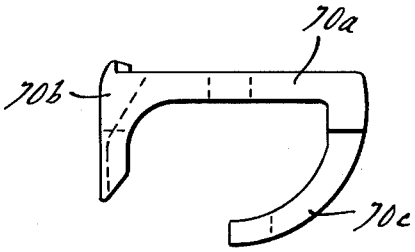
FIG. 11 is a front view of the element of FIG. 9.

Each throttle blade assembly in the preferred embodiment is identical to minimize manufacturing costs. As best seen in FIG. 5, each throttle blade assembly comprises a blade 70, a wiper 72, and a wiper retaining plate 74, the three of which are secured together by means of a pair of tubular rivets, or eyelets 76. The blades 70 are advantageously constructed as an extrusion to form the desired cross sectional shape with the individual blades being cut to length from the extrusion. Each blade 70 may be considered as comprising three sections **70*a*, 70*b*, and 70*c*. The first blade section 70*a* is of generally rectangular shape and lengthwise fits fairly closely within the corresponding port between the corresponding wall of the induction passage and the corresponding wall of partition 48. The second blade section 70*b* is provided at the juxtaposition of the blades of each cooperating blade pair. The second blade sections of each cooperating blade pair cooperatively define a pair of venturis 78, half of each venturi being defined by one blade and the opposite half by the other blade. The blade sections 70*b* are designed to coalesce as shown in FIGS. 3 and 5 when the assembly is in idle position. As the throttle blades are displaced from idle position, over the part throttle range, they remain in coalescense along an imaginary line indicated in FIG. 5 by the reference numeral 79. The effective size of the venturis correspondingly increases over this range. As the blades are increasingly rotated, a point is reached where the blades separate and such separation increases until the full throttle position of FIG. 4 is attained. The third blade section 70*c* of each blade presents a curved confronting surface to the corresponding wall section 24*c*, 24*d* and cooperates with a roller sealing arrangement (hereinafter described) to seal the blades with respect to the wall sections 24*c*, 24*d*. The surface of each blade section 70*c*** lies on a circular arc concentric with the axis of the corresponding shaft and has a radius of curvature less than the minimum distance from the shaft axis to the wall section.

As best shown in FIGS. 3 and 4, the throttle blade assemblies are affixed to their respective throttle shafts by means of attaching screws 80 which pass through eyelets 76 into tapped holes in the throttle shafts. The throttle shafts are provided with suitable flats to receive the throttle blades within the ports of the induction passage. It is preferable to upset the distal ends of the screws 80 as indicated at 82 once the screws have been tightened to secure the blades in the desired positions, the clearance notches 83 being provided in each blade to provide suitable tool clearance for the upsetting operation.

The venturi sections improve the quality of air fuel mixture at idle and at part throttle. In order to achieve maximum benefit of the venturi sections, sealing of the throttle blade assemblies with the walls of induction passage 24 and partition 48 is required. Sealing of the throttle blade assemblies with the induction passage walls **24*c*, 24*d* is accomplished by means of roller type seals. For this purpose, a roller 84 is provided for each throttle blade assembly. Each roller is caged on the corresponding wall 24*c*, 24*d* and has a rolling sealing contact with respect to the third blade section 70*c* of each blade assembly along the length of the blade. Each roller is caged by means of a corresponding insert 86 affixed to the corresponding wall 24*c*, 24*d* within the induction passage by means of attaching screws 88 which pass through suitable apertures in the wall of throttle body 22 to engage matching tapped holes in the inserts 86. The upper surface of each insert 86 tapers downwardly away from the corresponding passage wall so that each roller 84 tends to roll into engagement with the curved blade section 70*c* of the corresponding blade assembly. The caging is completed by means of a retainer 90 which fits over the top of the throttle body and includes retaining fingers 92 which protrude into the induction passage closely along each of the walls 24*c*, 24*d*. The retainer is secured in place by means of retention fingers 94 which extend downwardly over the outside of and snap into retentive engagement with the throttle body as best seen in FIGS. 3 and 4. As the throttle blades rotate over their operative range the rollers 84 maintain a rolling sealing contact with the blade sections 70*c*. Wiping type seals for sealing with respect to the remaining walls of each port are provided by wipers 72 which are disposed on the top of the first blade section 70*a* of each blade. The lengthwise dimension of each wiper 72 is slightly greater than the straight-line distance between the wall sections 24*a*, 24*b* and partition 48 so as to provide a wiping action against the induction passage and partition walls. It is desirable to utilize a retainer 74 to retain the less rigid wiping element 72** so that the desired wiping sealing action is achieved.

From the foregoing description one will understand that the sealing arrangement is effective to confine induction flow into the central region of the induction passage. The venturi sections are effective at idle and at part throttle to promote more complete atomization of fuel at idle and part throttle. Beyond part throttle position the separation of the two blades of each cooperating pair permits maximum air flow for engine requirements at higher engine loads. The preferred embodiment is advantageous in that close tolerance requirements for the throttle blade assemblies within the induction passage are not required because variations in dimensions can be taken up by the sealing arrangements. While a two-port configuration has been disclosed it will be appreciated that single or multiple port configurations may be constructed in accordance with the principles of the present invention.

What is claimed is:

1. A throttle body assembly comprising in combination:

a throttle body having an induction port passage therein comprising four flat walls which, in transverse cross section perpendicular to the axis of the passage, define a rectangular cross section for the passage;

a pair of parallel shafts extending across said passage, each shaft being journaled for rotation on the throttle body about its own axis, one of said shafts being disposed between the passage axis and one wall of said passage, the other shaft being disposed between the passage axis and the opposite passage wall;

a first throttle blade disposed within said passage between the remaining two walls thereof and affixed to said one shaft, said first throttle blade comprising a first blade section which, in idle position, extends from said one wall partially across said passage toward said opposite wall but stops short of said other shaft;

a second throttle blade disposed within said passage between said remaining two walls thereof and affixed to said other shaft, said second throttle blade also comprising a first blade section which, in idle position, extends from said other wall partially across said passage toward said first throttle blade;

means for counter-rotating said shafts to effect counter-rotation of said throttle blades;

said two throttle blades each comprising a second blade section at the juxtaposition of the first blade sections thereof, said second blade sections providing coalescence of said throttle blades at the juxtaposition thereof at idle and over part-throttle range from idle except at one or more venturis cooperatively defined thereby which are shaped to vary in effective size as said throttle blades are displaced over said part-throttle range, said throttle blades being shaped to depart from coalescence for displacement thereof beyond said part-throttle range;

said first throttle blade comprising a third blade section presenting a curved confronting surface to said one wall which, when viewed in a transverse cross section perpendicular to the axis of said one shaft, is disposed on an at least approximately circular arc which is at least approximately concentric with the axis of said one shaft and has a radius of curvature smaller than the minimum distance from the axis of said one shaft to said one wall;

means for sealing said first throttle blade with respect to said one wall comprising a roller having its axis parallel to that of said one shaft and means for caging said roller between said one wall and said first throttle blade with said roller having a rolling sealing contact with the third blade section of said first throttle blade;

said second throttle blade also comprising a third blade section presenting a curved confronting surface to said other wall which, when viewed in a transverse cross section perpendicular to the axis of said other shaft is disposed on an at least approximately circular arc which is at least approximately concentric with the axis of said other shaft and has a radius of curvature smaller than the minimum distance from the axis of said other shaft to said other wall;

means for sealing said second throttle blade with respect to said other wall comprising another roller having its axis parallel to that of said other shaft and means for caging said last-mentioned roller between said other wall and said second throttle blade with said last-mentioned roller having a rolling sealing contact with the third blade section of said second throttle blade;

and means for sealing said two throttle blades with respect to said remaining two passage walls comprising first wiper means disposed on the first blade section of said first blade and having an overall length greater than that of the first blade section on which it is disposed with its end edges extending beyond the end edges of the first blade section on which it is disposed so that it provides a wiping sealing contact with said remaining two passage walls and second wiper means disposed on the first blade section of said second blade and having an overall length greater than that of the first blade section on which it is disposed with its end edges extending beyond the end edges of the first blade section on which it is disposed so that it provides a wiping sealing contact with said remaining two passage walls, said first and second wiper means being shaped to provide clearance for said one or more venturis.

2. A throttle body assembly as claimed in claim 1 wherein said first and second throttle blades are identical in size and shape.

3. A throttle body assembly as claimed in claim 1 wherein said two shafts are parallel to each other.

4. A throttle body assembly as claimed in claim 1 including a retainer for each wiper means.

5. A throttle body assembly as claimed in claim 1 wherein each wiper means is affixed to the corresponding throttle blade by a tubular rivet and each blade is affixed to the corresponding shaft by a fastener passing through the corresponding tubular rivet to engage the corresponding shaft.

6. A throttle body assembly as claimed in claim 1 wherein each throttle blade is an extrusion.

7. A throttle body assembly as claimed in claim 1 wherein said second blade sections are displaced downstream of the induction passage as the throttle blades are increasingly displaced from idle.

8. A throttle body assembly as claimed in claim 1 wherein each roller caging means comprises an insert on the corresponding passage wall, the corresponding roller being supported on the corresponding insert, and a retainer confining the roller in the passage between itself and the insert.

* * * * *